US006766846B2

(12) United States Patent
Song et al.

(10) Patent No.: US 6,766,846 B2
(45) Date of Patent: Jul. 27, 2004

(54) ELECTRIC BLIND

(76) Inventors: Myoung-Ho Song, 1172-4, Baeksok-Dong, Hsan-Ku, Koyang City, Kyonggi-Do (KR); Young-Hwan Song, 1172-4, Baeksok-Dong, Hsan-Ku, Koyang City, Kyonggi-Do (KR)

( * ) Notice: Subject to any disclaimer, the term of this patent is extended or adjusted under 35 U.S.C. 154(b) by 0 days.

(21) Appl. No.: 10/400,272

(22) Filed: Mar. 26, 2003

(65) Prior Publication Data

US 2003/0192652 A1 Oct. 16, 2003

(30) Foreign Application Priority Data

| | | |
|---|---|---|
| Apr. 12, 2002 | (KR) | 2002-0019975 |
| Apr. 12, 2002 | (KR) | 2002-0019976 |
| Nov. 29, 2002 | (KR) | 2002-0075384 |
| Nov. 29, 2002 | (KR) | 2002-0075385 |

(51) Int. Cl.[7] ..... E06B 9/26

(52) U.S. Cl. ..... 160/168.1 P; 160/171 R; 160/DIG. 17

(58) Field of Search ..... 160/168.1 P, 170 R, 160/171 R, 176.1 P, DIG. 17, 84.02, 188

(56) References Cited

U.S. PATENT DOCUMENTS

| | | | | |
|---|---|---|---|---|
| 5,178,200 | A * | 1/1993 | Hagen | 160/107 |
| 5,318,090 | A * | 6/1994 | Chen | 160/171 |
| 6,619,365 | B1 * | 9/2003 | Wen et al. | 160/168.1 P |
| 6,655,441 | B2 * | 12/2003 | Wen et al. | 160/168.1 P |
| 6,659,156 | B2 * | 12/2003 | Wen et al. | 160/168.1 P |

* cited by examiner

*Primary Examiner*—David Purol
(74) *Attorney, Agent, or Firm*—Galgano & Burke LLP

(57) ABSTRACT

An electric blind, which is efficiently raised and lowered and controlled in a tilt angle of its vanes by a single drive motor, is disclosed. The electric blind includes a mount frame, fixedly mounted on a wall over a window and having a certain length, a pair of housings attached to both ends of the mount frame, a pair of take-up cylinders rotably coupled to the housings, lifting cords wound around the pair of take-up cylinders and unwound therefrom to be suspended by a certain length, a rotating pipe, disposed between and joined to the pair of take-up cylinders and rotated in forward and reverse directions, a drive motor connected to the rotating pipe, a plurality of vanes disposed below the pair of housings to be raised and lowered by the lifting cords, and means for controlling tilt angle of the vanes by a turning force of the rotating pipe.

11 Claims, 16 Drawing Sheets

ELECTRIC BLIND

BACKGROUND OF THE INVENTION

1. Field of the Invention

The present invention relates to an electric blind installed at a window, and more particularly to an electric blind, which is designed to be automatically extended and folded and to be controlled in a tilt angle of vanes thereof, by remote control.

2. Description of the Prior Art

In general, windows of dwellings, offices and the like are equipped with curtains or blinds to assure security for a dweller' privacy, as well as for natural lighting and thermal insulation, which are adapted to be expanded or retracted as necessary.

Blinds used in such applications are usually classified into a vertical-type blind and a horizontal-type blind. Both types are commonly constructed to control an amount of light incoming therethrough by adjusting a tilt angle of vanes thereof, but designs diverge, in that there is a difference in the direction of extension and folding of the vanes in the two types.

In conventional manual type blinds, since a user must go to the blind and then pull on a desired string in order to raise or lower the blind or control the tilt angle of its vanes, it is inconvenient to use.

To solve these problems, various electric blinds, which are electrically operated by remote control, are proposed these days. Since such a conventional electric blind has to be equipped with a motor for raising and lowering the blind and a motor for controlling the tilt angle of blind's vanes of the blind, there are problems in that the number of overall components, and thus production cost, is increased.

SUMMARY OF THE INVENTION

Accordingly, the present invention has been made keeping in mind the above problems occurring in the prior art, and an object of the present invention is to provide an electric blind, which can be electrically and easily raised and lowered, and which enables easy and stable control of tilt angle of its vanes, by manipulation of a remote control.

Another object of the present invention is to provide an electric blind, which enables simplification of components for controlling a tilt angle of vanes and is lower in the number of the components, thereby improving productivity and maintenance of the blind.

In order to accomplish the above object, the present invention provides an electric blind comprising: a mount frame fixedly mounted on a wall over a window and having a certain length; a pair of housings attached to both ends of the mount frame; a pair of take-up cylinders rotably coupled to the housings; lifting cords wound around the pair of take-up cylinders and unwound therefrom to be suspended by a certain length; a rotating pipe disposed between and joined to the pair of take-up cylinders and rotated in normal and reverse directions; a drive motor connected to the rotating pipe; a plurality of vanes disposed below the pair of housings to be raised and lowered by the lifting cords; and means for controlling tilt angle of the vanes via a turning force of the rotating pipe.

Each of the take-up cylinders may be provided at its outer surface with a threaded portion and provided at its inner surface with at least one fitting protrusion, and each of the housings may be provided at its inner surfaces with a threaded portion to mate with the threaded portion of the take-up cylinder and the rotating pipe may be provided at its outer surface with a fitting groove corresponding to the fitting protrusion, whereby the pair of take-up cylinders are moved toward and away from each other during rotation of the rotating pipe.

The means for controlling tilt angle of the vanes may comprise a rotating shaft axially joined to an end of the rotating pipe, a first rotating cam rotatably coupled to an end of the rotating shaft, a second rotating cam rotatably supported below the first rotating cam and connected to the uppermost vane of the plurality of vanes, a connecting link connected at its both ends to the first rotating cam and the second rotating cam, and means for limiting rotation angle of the first rotating cam.

The means for limiting the rotation angle of the first rotating cam may comprise a pair of protrusions fixed to the first rotating cam to be positioned at diametrically opposing sides, catch members provided at the rotating shaft and coming into contact with the protrusions of the first rotating cam to transmit turning force of the rotating shaft to the first rotating cam, and a stopper fixed to the housing to limit a rotation range of the protrusions of the first rotating cam.

The means for controlling the tilt angle of the vanes may comprise a rotating ring fixedly mounted on the rotating pipe, a tilting string wound around an outer surface of the rotating ring and having ends connected to both sides of the uppermost vane of the plurality of vanes, and a spacer provided at an end of the tilting string facing the window to maintain a certain spacing between the uppermost vane and the rotating ring.

The spacer may be comprised of a plurality of balls, through which the end of the tilting string passes.

The mount frame may be provided at its center with a control screw adapted to be displaced upward and downward, and a control wire connected at its one end to the control screw and connected at its other end to the uppermost vane of the plurality of vanes.

The electric blind may further include a holding bracket for fixing the mount frame to the wall, which includes bracket body having an end opening downward to receive the mount frame, and a bottom plate coupled the open end of the bracket body to support the mount frame.

The bracket body may be formed at its one end with a first slit and formed at its other end with a retaining protrusion, and wherein the bottom plate may be formed at its one end with a second slit to engage with the first slit of the bracket body, and formed at its other end with a cut portion to engage with the retaining protrusion of the bracket body.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

This invention will be described in further detail by way of example with reference to the accompanying drawings.

<First Embodiment>

Figure 2A:
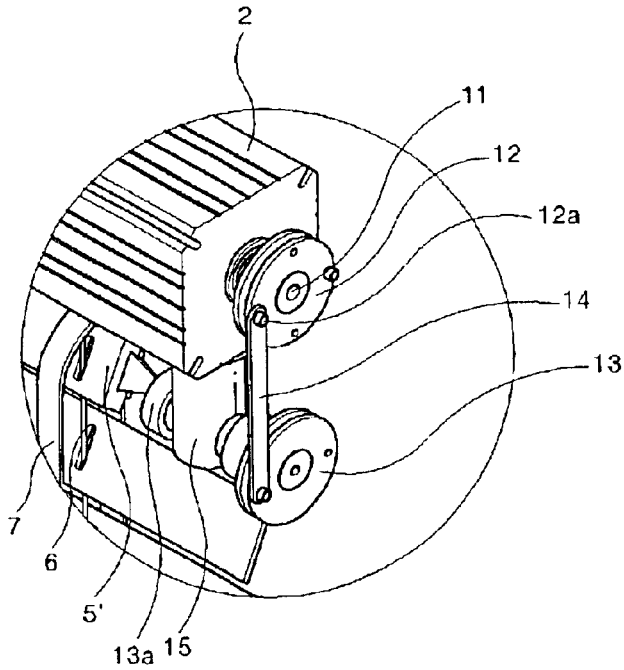
FIG. 2A is an enlarged view of circular portion A of FIG. 1.
Figure 2B:
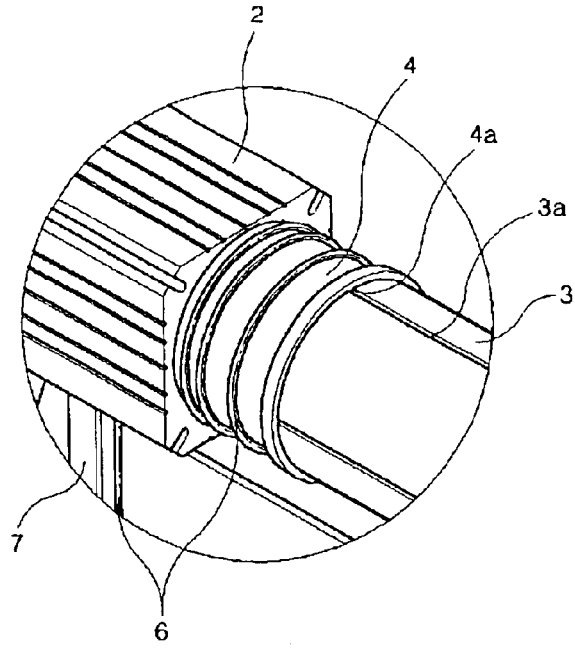
FIG. 2B is an enlarged view of circular portion B of FIG. 1.
Figure 3:
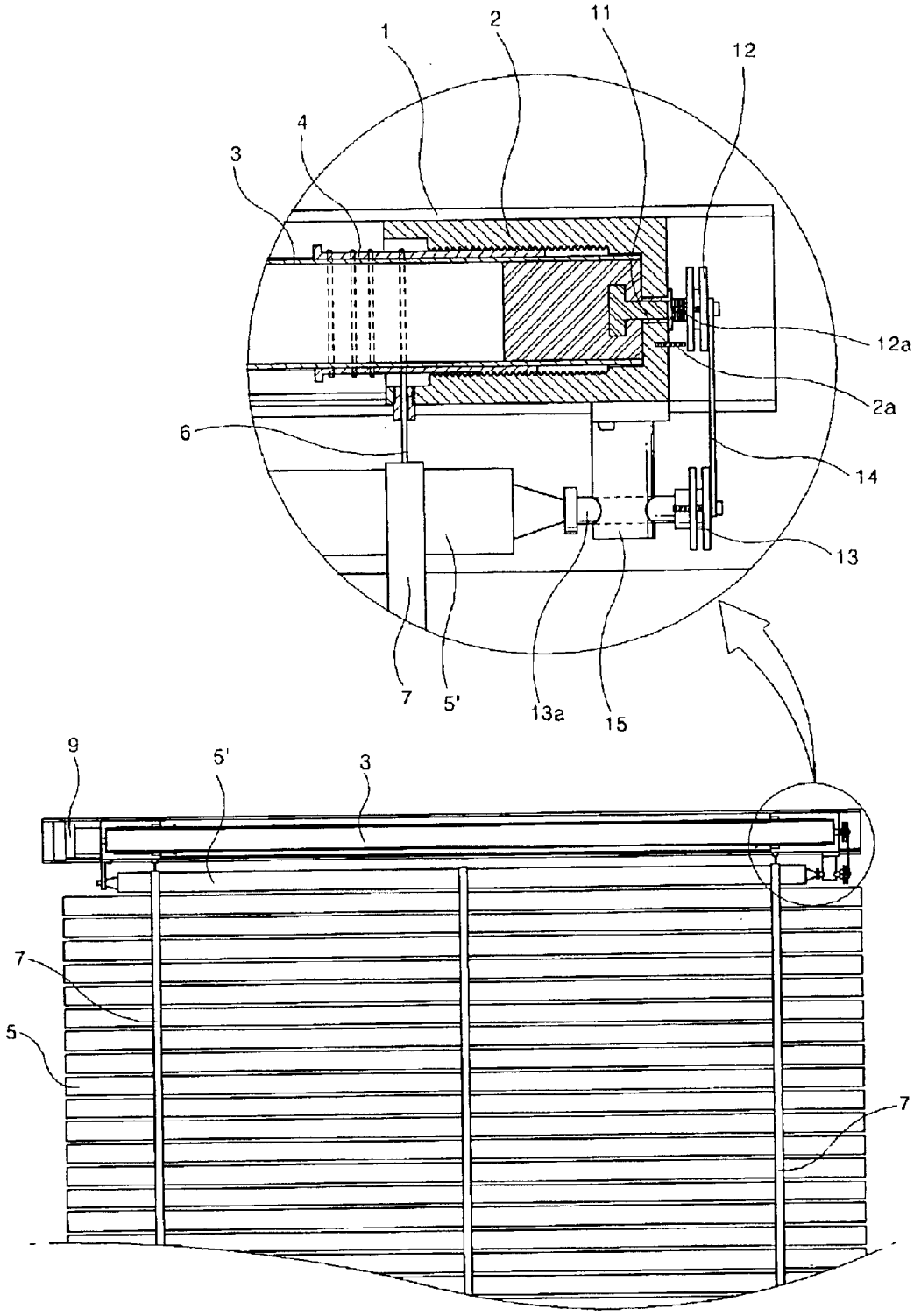
FIG. 3 is a cross-sectional view of substantial components of the electric blind according to the present invention.

Referring to FIGS. 1 to 5B, there is shown a structure for raising and lowering vanes of an electric blind according to a first embodiment of the present invention and a structure for controlling a tilt angle of vanes thereof. As shown in FIGS. 1 to 5B, a mount frame 1 is fixedly attached to an upper wall on a window by fastening means such as screws. A pair of housings 2 are attached to the mount frame 1 to be positioned near to opposite ends of the mount frame 1. As shown in FIG. 3, each of the housings 2 is provided at an inner surface with an internal threaded portion, and a take-up cylinder 4 having an outer threaded surface is engaged with the inner threaded portion of the housing 2. Therefore, as the take-up cylinders 4 are rotated by a turning force transmitted thereto, the take-up cylinders 4 are horizontally moved toward or away from each other while being supported in the houses 2. A rotating pipe 3, to which turning force from a drive motor 9 is transmitted, is coupled to the take-up cylinders 4 at its opposite ends so as to transmit the turning force to the take-up cylinders 4.

Each of the take-up cylinders 4 is provided at inner surface thereof with a plurality of longitudinally extending protrusions 4*a* with a uniform spacing therebetween, and the rotating pipe 3 is provided at its outer surface with fitting grooves 3*a* corresponding to the longitudinal protrusions 4*a*. Consequently, turning force is transmitted between the take-up cylinders 4 and the rotating pipe 3.

A pair of lifting cords 6 are wound around the take-up cylinder 4, which are intended to raise and lower vanes 5 of the blind, as shown in FIG. 2B. The lifting cords 6 pass through the vanes 5. The vanes 5 are supported by a pair of support strips 7 to be controlled in tilt angle thereof. The support strips 7 are provided with retaining strings (not shown) at a uniform spacing, so as to maintain a certain spacing between the vanes 5.

A rotating shaft 11, serving as means for controlling the tilt angle of vanes 5, is axially fitted into an end of the rotating pipe 3. A first rotating cam 12 is rotatably coupled to an outer end of the rotating shaft 11. A second rotating cam 13*a* is positioned below the first rotating cam 13, and a connecting link 14 is connected between the first rotating cam 13 and the second rotating cam 13*a* so as to transmit turning force of the first rotating cam 13 to the second rotating cam 13*a*. A cam shaft 13*a* of the second rotating cam 13 is coupled to the uppermost 5' of the vanes 5 so as to transmit turning force of the second rotating cam 13 to the uppermost vane 5'. The cam shaft 13*a* of the second rotating cam 13 is supported by a holding bracket 15.

Figure 4:
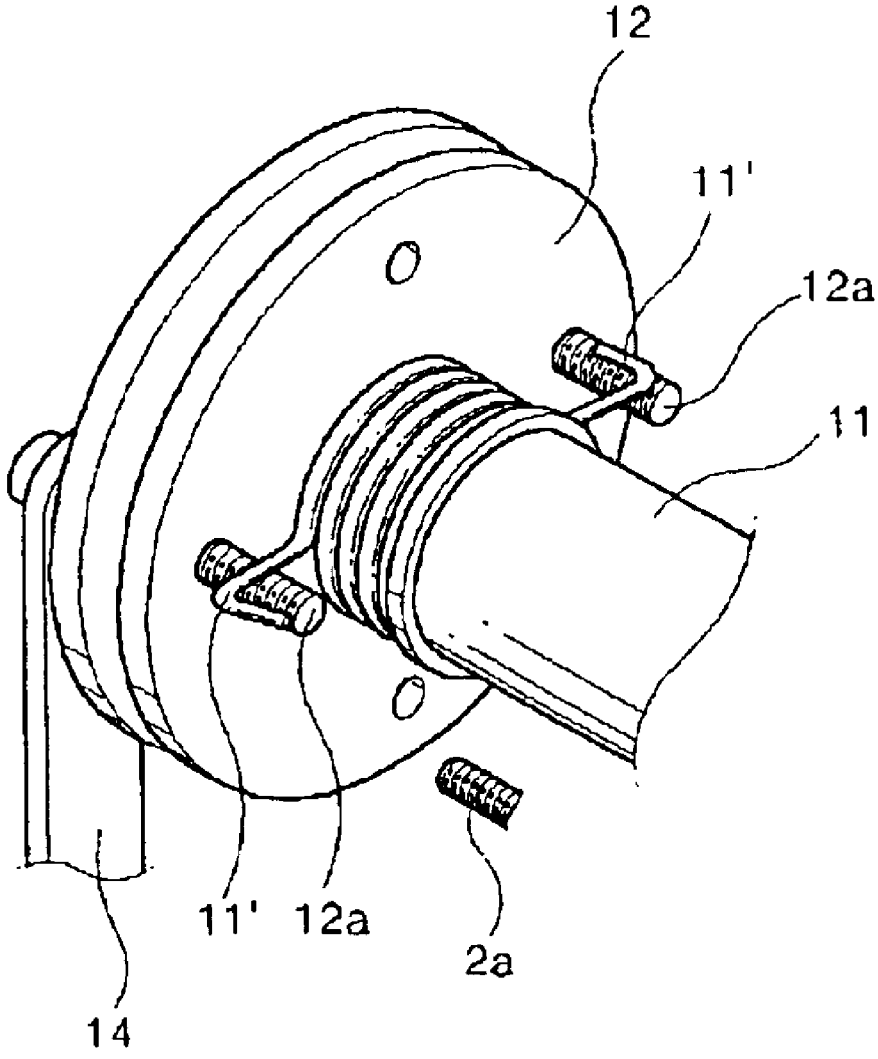
FIG. 4 is a perspective view of a first rotating cam of the electric blind according to the present invention, which shows a rear side of the first rotating cam.

As shown in FIG. 4, the first rotating cam 12 is provided at its diametrically opposite sides with a pair of protruded screws 12*a* fixed thereto. A coil spring having both catch ends 11' is fitted over an outer end of the rotating shaft 11 so as to transmit forward and reverse turning force of the rotating shaft 11 to the first rotating cam 12. To limit the rotation angle of the rotation shaft 11 within a range of 180 degrees, the housing 2 is provided with a stopper 2*a*.

Operation and functions of the electric blind according to the first embodiment of the present invention will now be described.

When a power signal is applied to the blind by a remote control or a power switch, the drive motor 9 is driven to rotate the rotating pipe 3 in a forward direction, so that both take-up cylinders 4, threadedly coupled with the housing 2, are rotated, thereby allowing the lifting cords 6 wound around the take-up cylinders 4 to be unwound.

During the rotation of the take-up cylinders 4, the take-up cylinders 4 are gradually moved away from each other while the housings 2 are maintained at a fixed position. Consequently, although the lifting cords 6 are wound around the outer surfaces of the take-up cylinders 4 over certain widths, positions through which the lifting cords 6 are wound and unwound around the take-up cylinders 4, are constantly maintained, thereby preventing tangling of the lifting cords 6.

Figure 1:
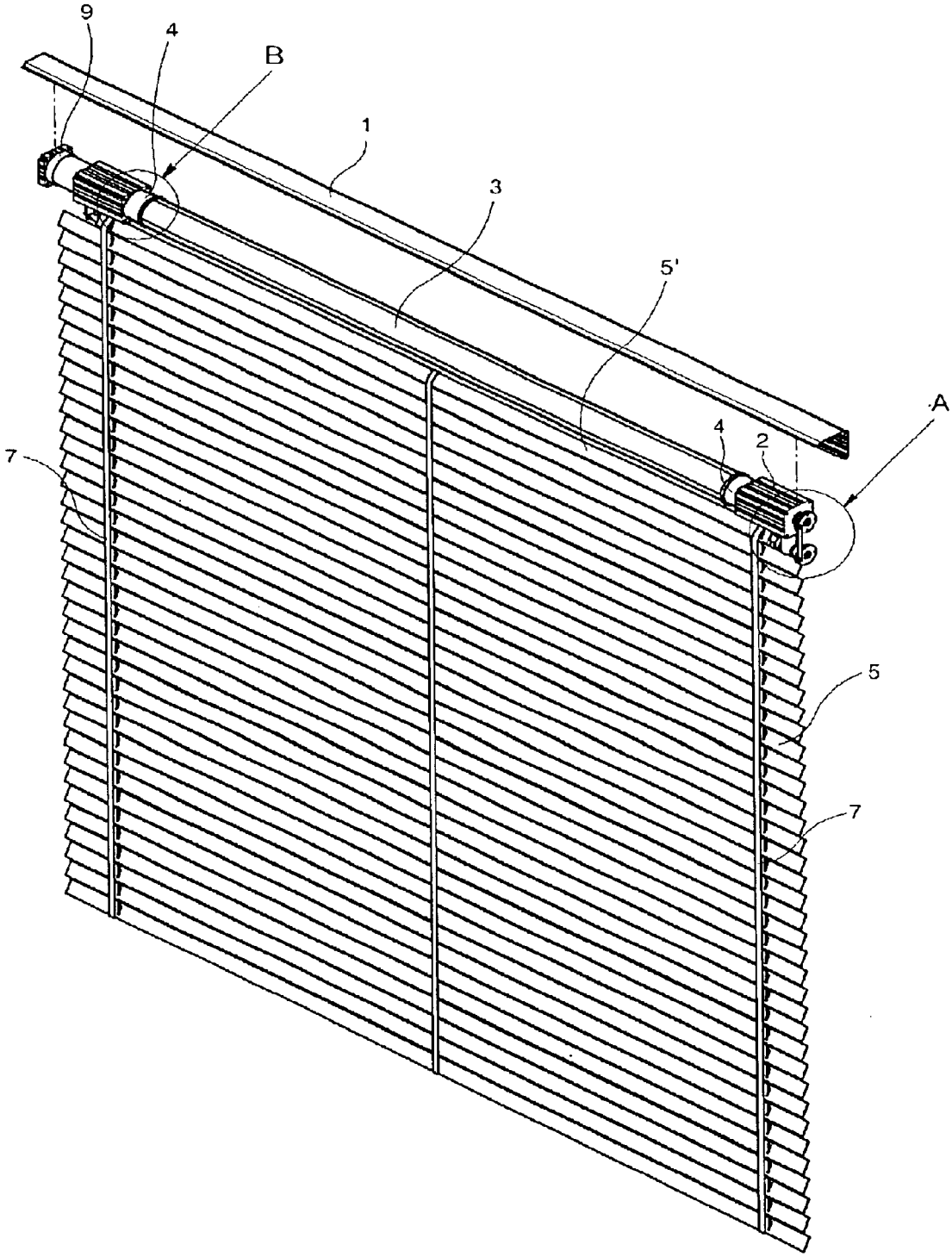
FIG. 1 is a perspective view showing an appearance of an electric blind according to a first embodiment of the present invention.
Figure 5A:
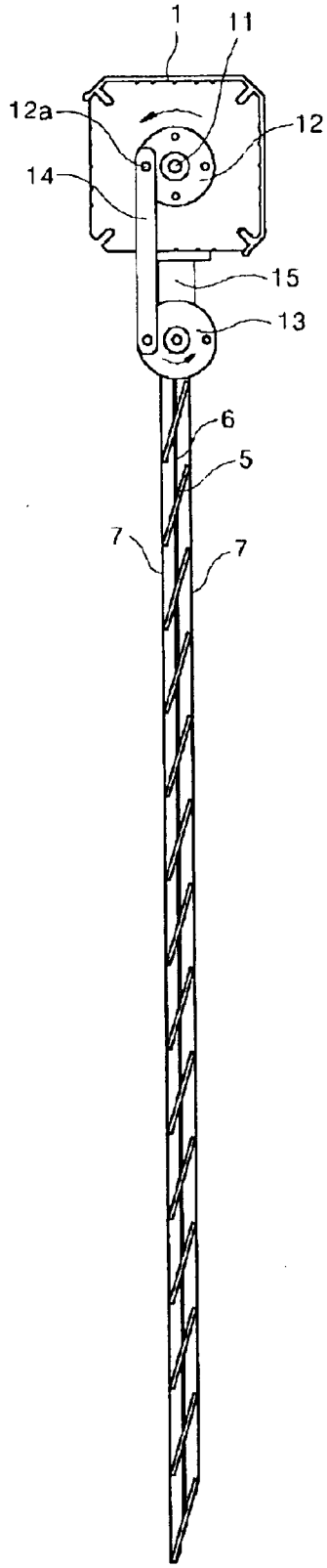
FIG. 5A is a side view of the electric blind according to the present invention, in which the blind is lowered.

As the lifting cords 6 are unwound from the take-up cylinder 4, the plurality of vanes 5 are sequentially extended to screen the window, thereby shielding the dweller in the house from public view, as illustrated in FIGS. 1 and 5A.

Figure 5B:
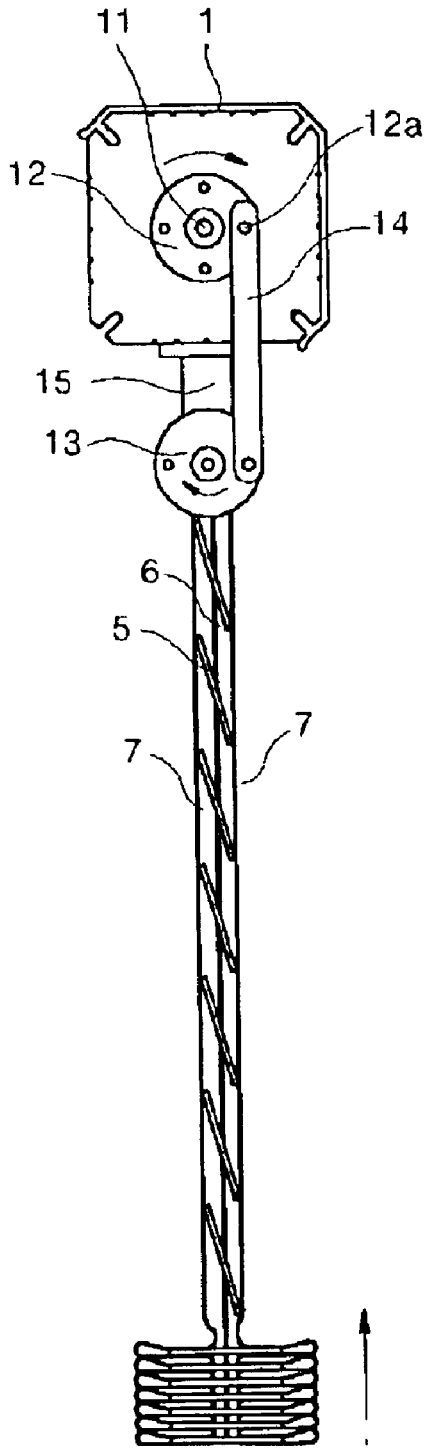
FIG. 5B is a side view of the electric blind according to the present invention, in which the blind is raised.

When it is required to raise the blind to reveal the window, the drive motor 9 is applied with a reverse driving signal to rotate the rotating pipe 3 in the reverse direction. With the reverse rotation of the rotating pipe 3, the take-up cylinder 4 is also rotated in the reversed direction to wind the lifting cords 6 thereon. Consequently, the vanes 5 are sequentially folded from the bottom up, as illustrated in FIG. 5*b*.

During the winding operation of the lifting cords 6, the take-up cylinders 4 are horizontally moved in the direction opposite to the moving direction of the take-up cylinders 4 in the winding operation, because the take-up cylinders 4 are threadedly engaged with the housings 2 mounted on the mount frame 1. Therefore, the lifting cords 6 are uniformly wound around the outer surface of the take-up cylinders 4 over a certain width.

According to the present invention, tilt angle of the vanes 5 can be controlled by the turning force of the rotating pipe 3. The operation of controlling the tilt angle of vanes 5 is described hereinafter, with reference to FIG. 3 and FIGS. 5A and 5B.

As the rotating pipe 3 is initially rotated by the drive motor 9, the turning force of the rotating pipe 3 is transmitted to the rotating shaft 11 to rotate the rotating shaft 11. Consequently, catch ends 11' of the coil spring, wound around the rotating shaft 11, come into contact with the screws 12*a* protruded from the first rotating cam 12 and push them in a certain direction, thereby transmitting turning force of the rotating shaft 11 to the first rotating cam 12. At this point, since the catch ends 11' of the coil spring are caught by the stopper 2*a* provided at the housing 1, the rotation angle of the rotating shaft 11 is limited to a range of 180 degrees.

The turning force of the first rotating cam 12 is transmitted to the second rotating cam 13 via the connecting link 14. Consequently, the cam shaft 13*a* of the second rotating cam 13 is rotated, so that the uppermost vanes 5' connected to the cam shaft 13*a* are rotated, thereby changing the tilt angle of the uppermost vanes 5'.

Therefore, the plurality of vanes 5 disposed below the uppermost vane 5' are tilted to the same angle as the tilt angle of the uppermost vane 5', by means of the support strips 7 connected to the uppermost vane 5' and the vanes 5. The plurality of vanes 5 are maintained in a tilted angle as shown in FIG. 5A when the blind is lowered, while the plurality of vanes 5 are maintained in a tilted angle as shown in FIG. 5B, i.e., in the inclined direction opposite to the inclined direction shown in FIG. 5A.

In this operation, although the rotation of the rotating shaft 11 connected to the rotating pipe 3 is limited to a certain range of rotation angle by the stopper 2*a*, the rotation pipe 3 is continually rotated together with the take-up cylinders 4, thereby winding or unwinding the lifting cords 6.

Accordingly, only initial turning force of the rotating pipe 3 is applied to the control of the tilt angle of the vanes 5, the subsequent turning force of the rotating pipe 3 is applied only to the raising and lowering motion of the vanes 5.

<Second Embodiment>

An electric blind according to a second embodiment of the present invention will now be described with reference to FIGS. 6 to 11. The housings 2 and the rotating pipe 3 are installed on the mount frame 1'. The drive motor 9 is connected to an end of the rotating pipe 3 to transmit to its driving force to the rotating pipe 3. The rotating pipe 3 is provided at its opposite ends with the take-up cylinders 4, on which the lifting cords 6 are wound to raise and lower the vanes 5.

Rotating rings 10 are fitted on the rotating pipe 3 to be rotated therewith. Each of the rotating rings 10 is provided at its inner surface with fitting protrusions 10*a*, which are engaged with fitting grooves 3*a* of the rotating pipe 3, so that the rotating ring 10 is rotated together with the rotating pipe 3. Each of the rotating rings 10 is further provided at its outer surface with a V-shaped circumferential groove lob, in which a tilting string 21 for controlling a tilt angle of the vanes 5 is wound. The tilting string 21 is connected to both sides of the uppermost vane 5' at its both ends. A plurality of balls 22 serving as a spacer are coupled to an outer end 21*a* of the tilting string 21 so as to maintain a certain spacing between the uppermost vane 5' and the rotating ring 10.

A control wire 25 is connected at its one end to the center of the mount frame 1' via a control screw 26, and is connected to the uppermost vane 5' at its other end.

Operation and functions of the electric blind according to the second embodiment of the present invention will now be described.

When power signal is applied to the blind by a remote control or a power switch, the drive motor 9 is driven to rotate the rotating pipe 3 in a forward direction, so that the both take-up cylinders 4 threadedly coupled with the housing 2 are rotated, thereby allowing the lifting cords 6 wound around the take-up cylinders 4 to be gradually unwound.

Figure 9:
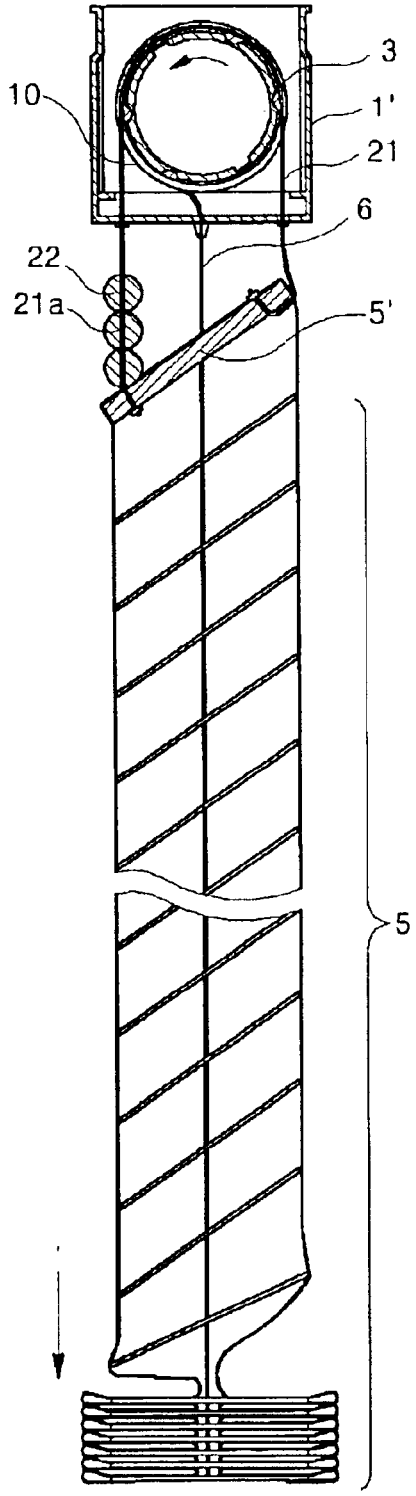
FIG. 9 is a side view of the electric blind according to the second embodiment of the present invention, in which the blind is lowered.

As the lifting cords 6 are unwound from the take-up cylinders 4, the vanes 5 are gradually lowered to obstruct the window. Accordingly, the rotating ring 10 is rotated together with the rotating pipe 3, and thus the tilting strings 21 wound in the V-shaped groove lob are biased outward, thereby allowing the vanes 5 to be inclined to a certain tilt angle, as shown in FIG. 9.

At this point, since the tilting strings 21 are completely biased outward, the tilting strings 21 are maintained in the biased position even though the rotating rings 10 continually rotate.

When the rotating pipe 3 is rotated in the reverse direction by user's manipulation, both take-up cylinders 4 are rotated in the reverse direction while winding the lifting cords 6 thereon, thereby causing the vanes 5 to be folded from the bottom up and thus causing the blind to be raised.

Figure 8:
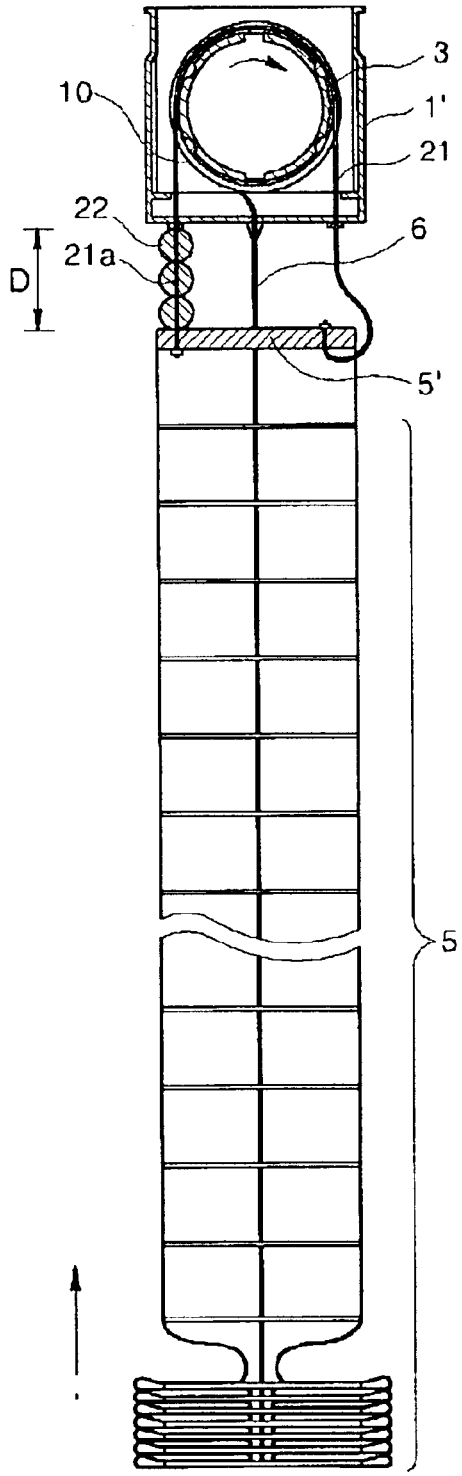
FIG. 8 is a side view of the electric blind according to the second embodiment of the present invention, in which the blind is raised.

By the reverse rotation of the rotating pipe 3, the rotating rings 10 are also rotated in the reverse direction, as shown in FIG. 8. At this point, since an inner end 21*a* of the tilting strings 21 is provided with plurality of balls 22, the vanes 5 are folded and raised while being maintained in a horizontal position.

More specifically, even though the tilting strings 21 are pulled in a reverse direction by the reverse rotation of the rotating rings 10, the inner ends 21*a* of the tilting strings 21 are raised only until the vanes 5 are horizontally positioned. This is because the inner ends 21*a* of the tilting strings 21 cannot be raised any more because of the balls 22 interposed between the uppermost vane 5' and the mount frame 1', as shown in FIG. 8. After the vanes 5 reach the horizontal position, the rotating rings 10 merely rotate, without pulling the tilting strings 21.

The control wire 25 is connected at its one end to the control screw 26 threadedly coupled to the center of the mount frame 1, and is connected at its other end to the uppermost vane 5', so as to control the range of the tilt angle of the vanes 5.

Figure 10:
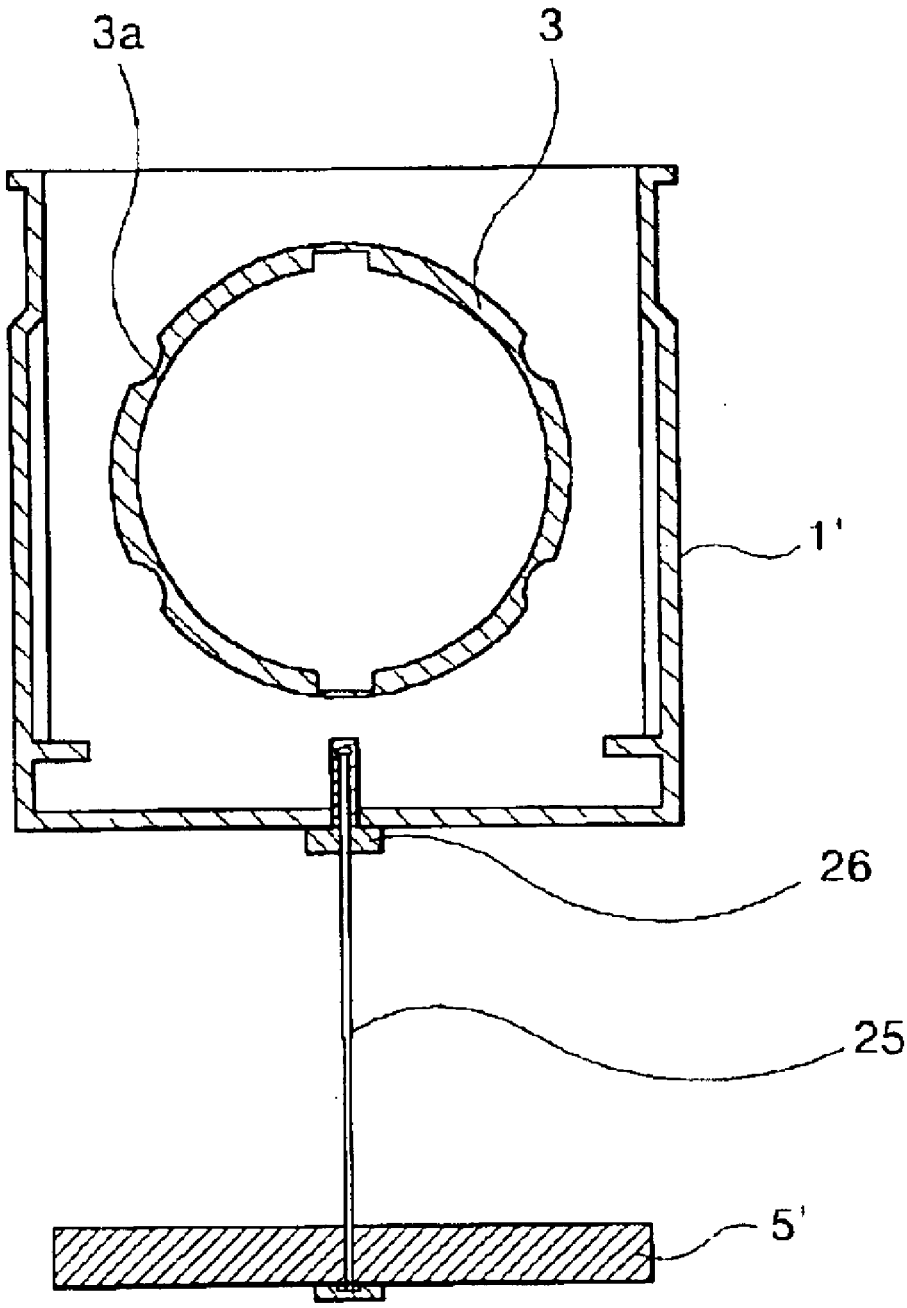
FIG. 10 is a side view showing a control wire of the electric blind according to the second embodiment of the present invention, in which the control wire is not controlled in its length.
Figure 11:
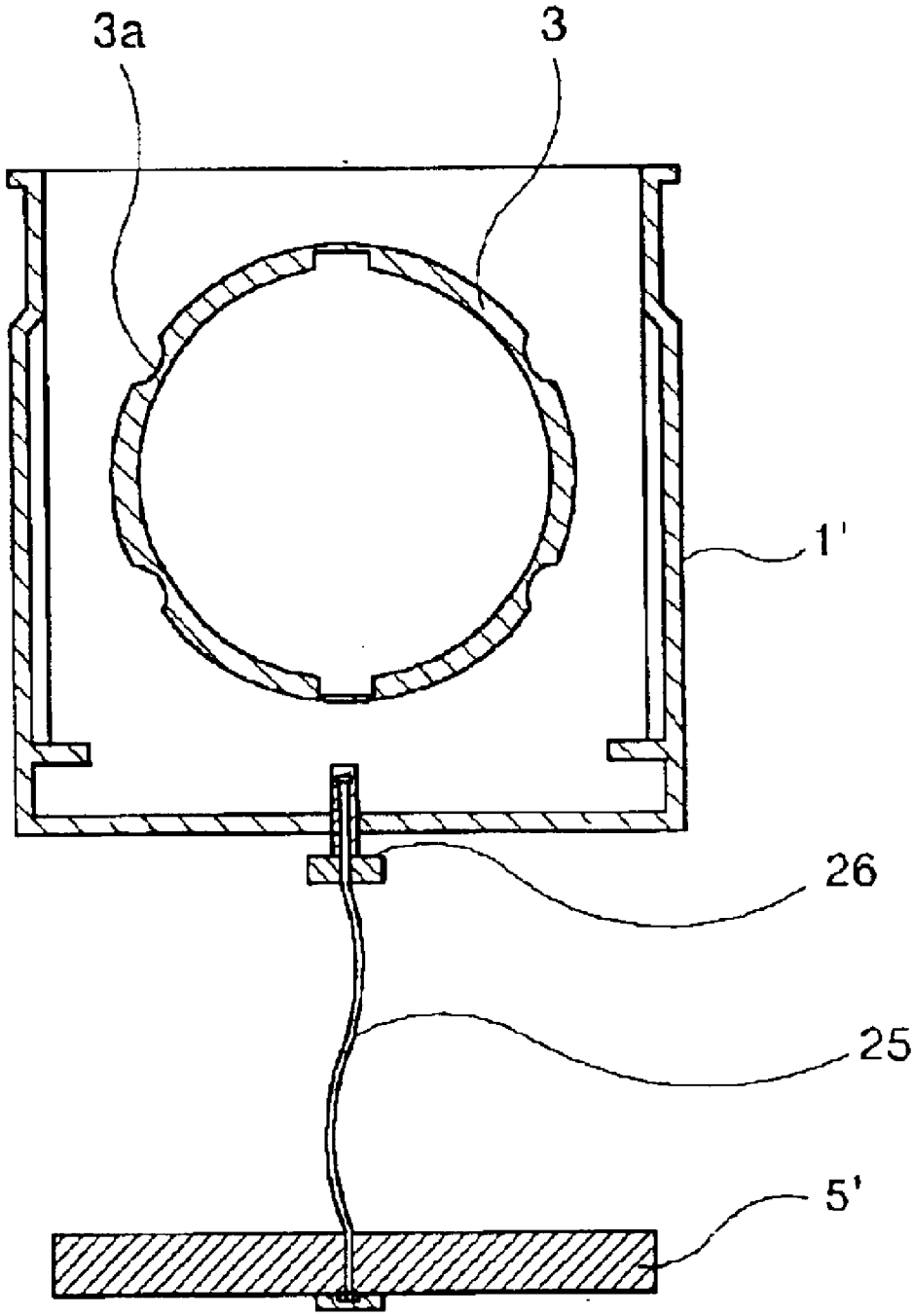
FIG. 11 is a side view showing a control wire of the electric blind according to the second embodiment of the present invention, in which the control wire is controlled in its length.

When the control wire 25 is tensed straight as shown in FIG. 10, the tilting angle range of the vanes 5 is decreased. On the other hand, when the control wire 25 is slightly loosened by unscrewing the control screw 26 as shown in FIG. 11, the range of the tilting angle of the vanes 5 is relatively increased.

<Third Embodiment>

Figure 12:
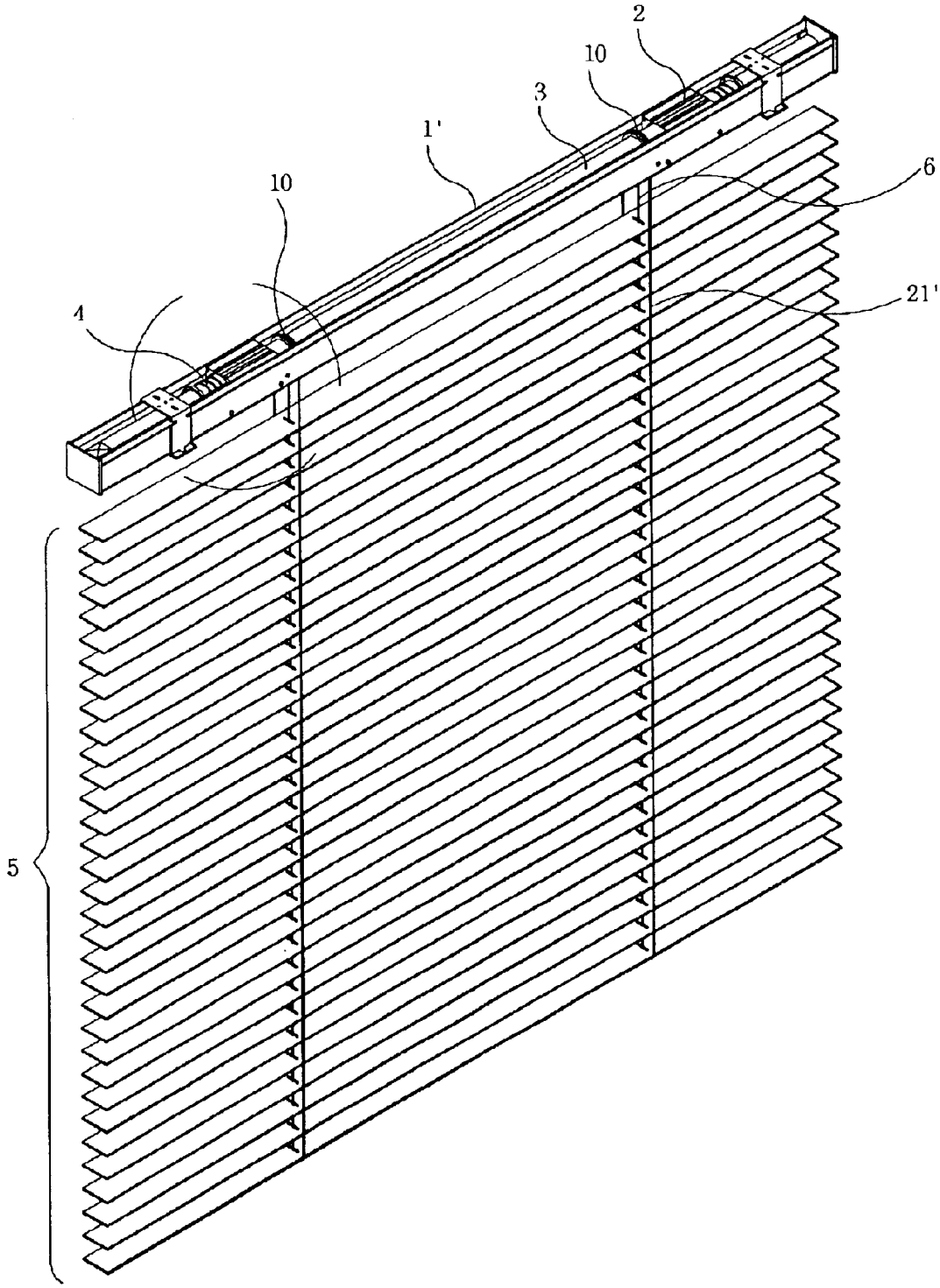
FIG. 12 is a perspective view showing an appearance of an electric blind according to a third embodiment of the present invention.
Figure 13:
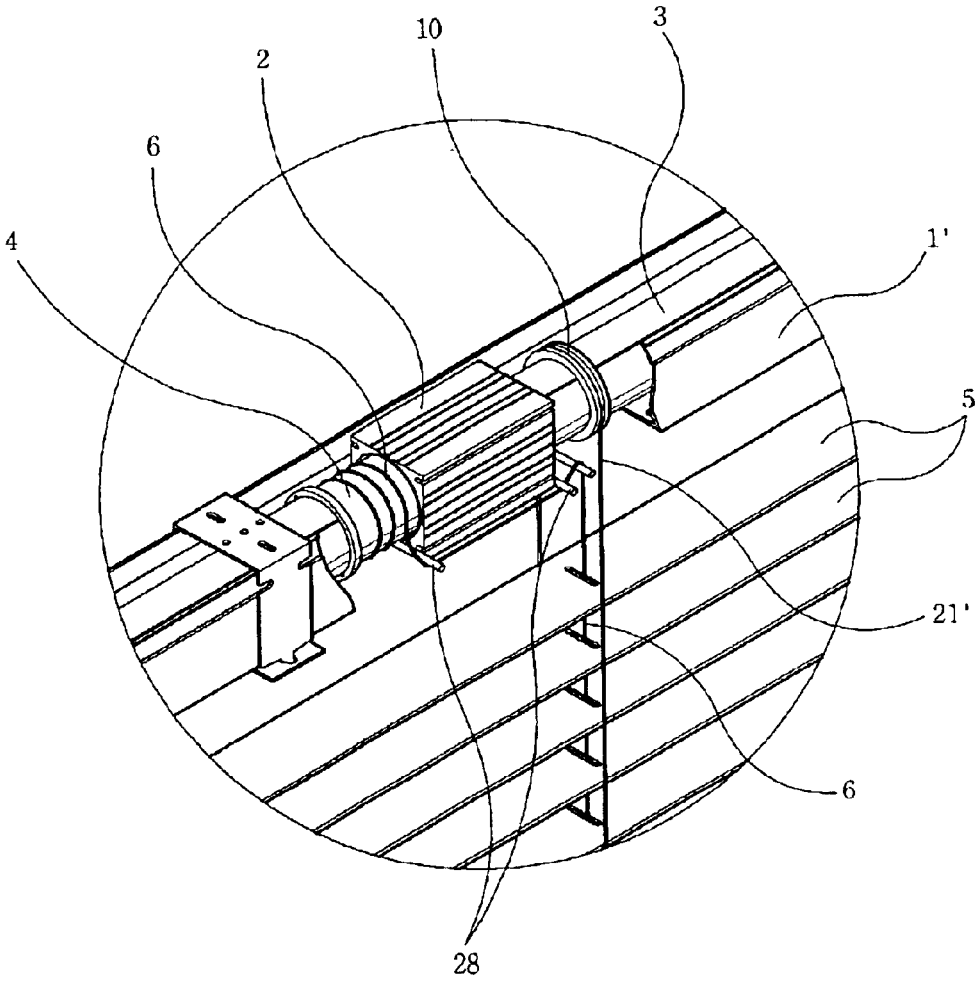
FIG. 13 is an enlarged perspective view of circular portion of FIG. 12.
Figure 14:
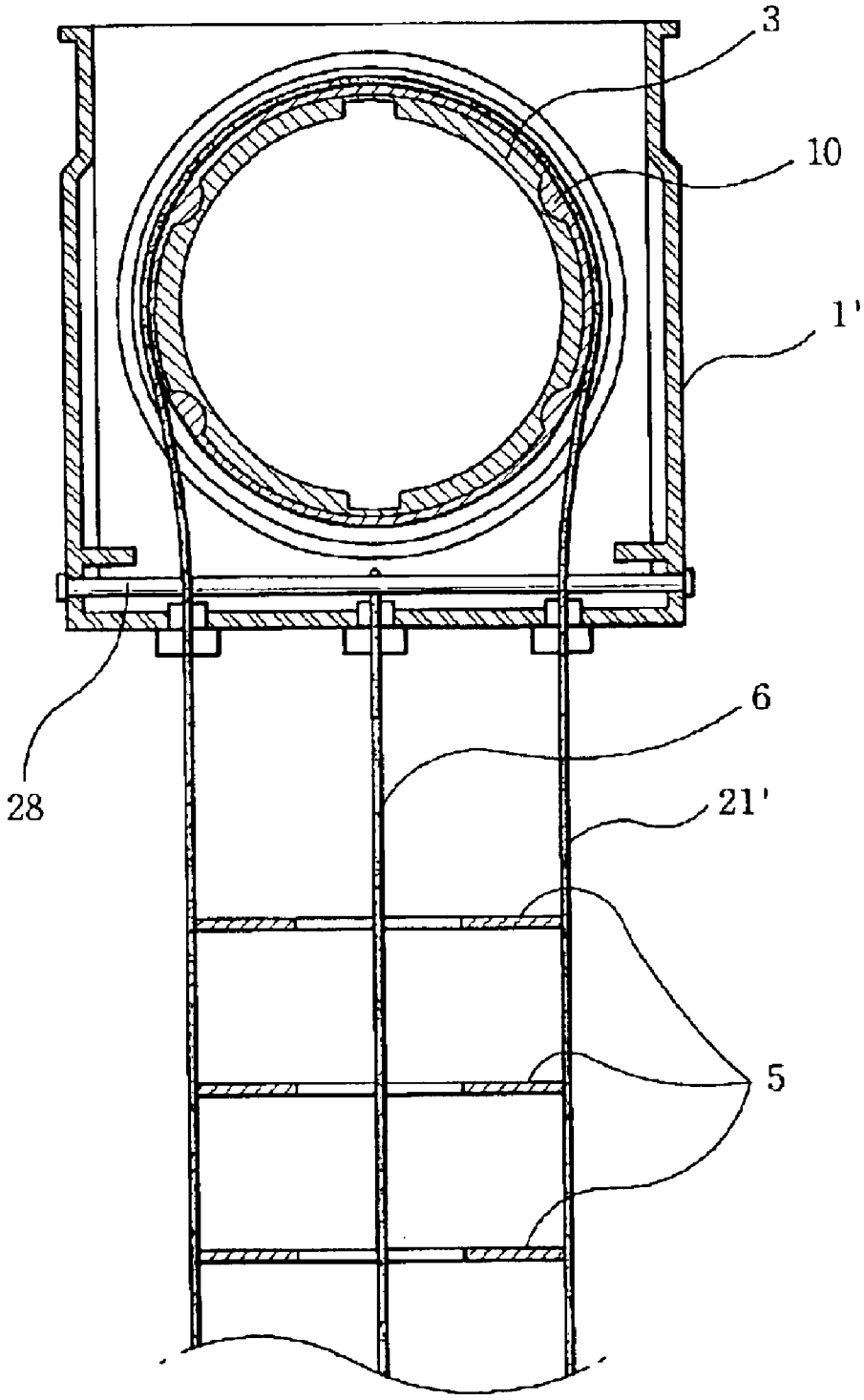
FIG. 14 is a cross-sectional view of a structure for controlling lifting and tilting of the electric blind of FIG. 12.

An electric blind according to a third embodiment of the present invention will now be described with reference to FIGS. 12 to 14.

The rotating rings 10 are fitted on the rotating pipe 3 to be rotated therewith. The rotating rings 10 are wound with tilting strings 21' to control a tilt angle of the vanes 5. The tilting strings 21' are extended downwardly and attached to both sides, i.e., front and rear sides of the respective vanes 5.

More specifically, in the above-described electric blind, the uppermost vane 5' is additionally provided over the vanes 5, and the support strips 7 are suspended from the front and rear sides of the uppermost 5', so as to control a tilt angle of the vanes 5. According to this embodiment, since the uppermost vane 5' is dispensable, a production cost is reduced and an appearance of the blind is improved.

Furthermore, since several guide pins 28 are fixedly attached to the mount frame 1' so as to guide the lifting cords 6 to positions between the support strips 7 and to hold the housing 2 in place, the lifting cords 6 are aligned with the support strips 7 to be shielded therefrom when viewed from a position of front of the blind, thereby improving an appearance of the blind and facilitating control of lifting and lowering operations of the blind.

Figure 15:
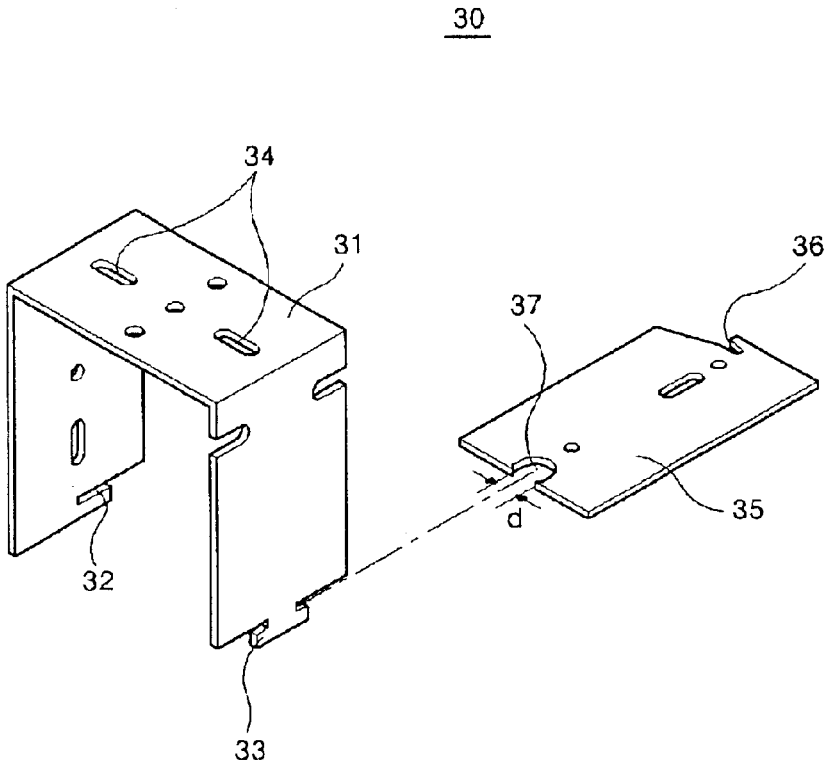
FIG. 15 is an exploded perspective view of a holding bracket according to the present invention.
Figure 16:
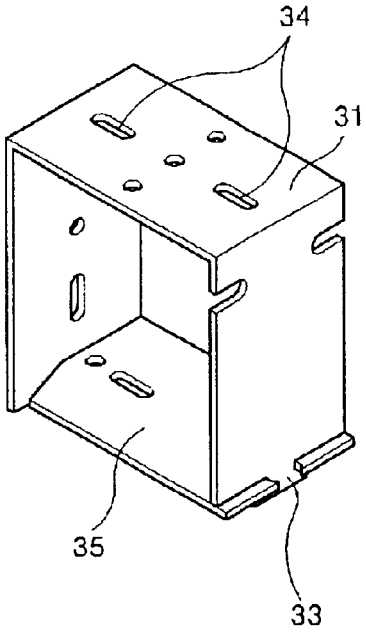
FIG. 16 is an assembled perspective view of a holding bracket according to the present invention.

Referring to FIGS. 15 and 16, there is shown a holding bracket 30, which is anchored to an upper wall to hold the mount frame 1'. The holding bracket 30 includes an inverted U-shaped bracket body 31 which opens downward to receive the mount frame 1', and a bottom plate 35 which is coupled to an open end of the bracket body 31 to support the mount frame 1'.

The bracket body 31 is formed at its one end with a horizontal slit 32, into which the bottom plate 35 is inserted, and is formed at its other end with a retaining protrusion 33. The bottom plate 35 is formed at its one end with a fitting slit 36 to engage with the horizontal slit 32 of the bracket body 31, and is formed at its other end with a cut portion 37 having a certain width "d" to engage with the retaining protrusion 33.

In an operation of installing the electric blind according to the present invention by the holding bracket 30, the bracket bodies 31 of the holding bracket 30 are first fixedly attached to an upper wall over a window by means of fastening means such as screws.

Thereafter, the mount frame 1', which suspends the plurality of vanes 5, is inserted into the open end of the bracket body 31, and then properly positioned. Therefore, the mount frame 1' is maintained at a certain height by the bottom plate 35 are coupled to the lower ends of the bracket bodies 31.

In an assembly of the holding bracket 30, after the cut portion 37 formed at one end of the bottom plate 35 is engaged with the retaining protrusion 33 of the bracket body 31, the fitting slit 36 formed at the other end of the bottom plate 35 is engaged with the horizontal slit of the bracket body 31, thereby completing a stable assembly of the holding bracket 30.

More specifically, after the bottom plate 35 is positioned such that an edge of the cut portion 37 of the bottom plate 35 is inserted into a slit of the retaining protrusion 33, as shown in FIG. 15, the bottom plate 35 is rotated counter-clockwise by an angle of 90 degrees around the retaining protrusion 33, thereby causing the fitting slit of the bottom plate 35 to be engaged with the horizontal slit 32 of the bracket body 31. Consequently, both opposite ends of the bottom plate 35 are retained in both ends of the bracket body 31.

Figure 6:
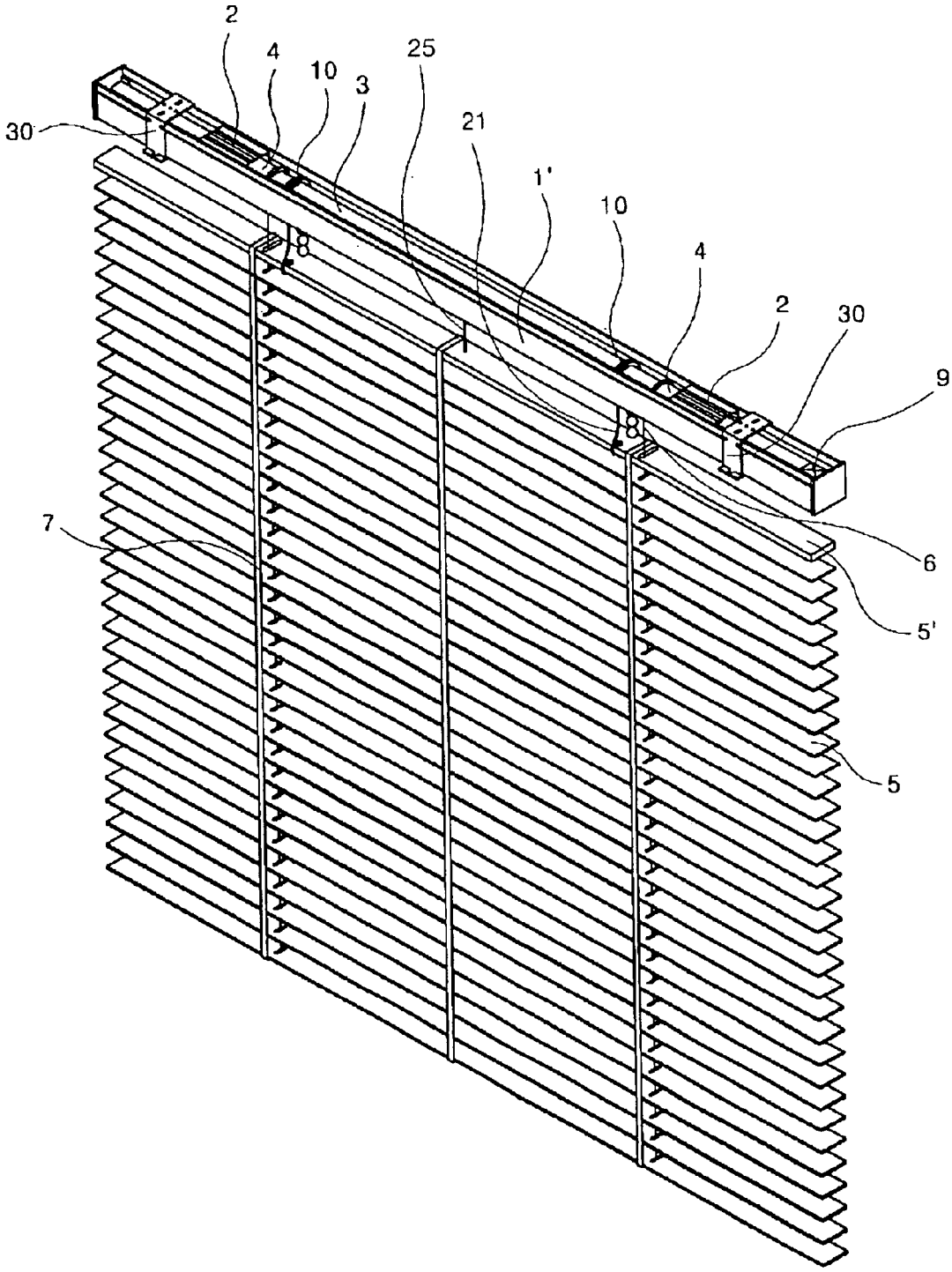
FIG. 6 is a perspective view showing an appearance of an electric blind according to a second embodiment of the present invention.
Figure 7:
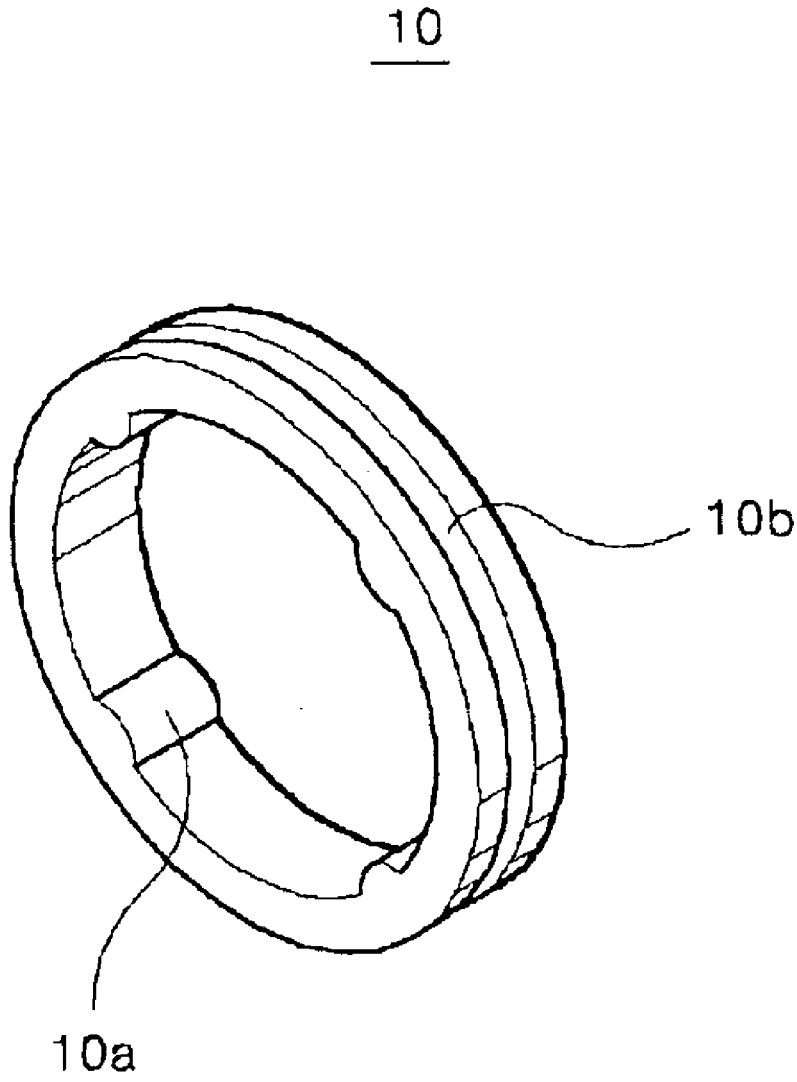
FIG. 7 is a perspective view of a rotating ring of the electric blind according to the second embodiment of the present invention.

By the above-described operation, the holding brackets 30 can be quickly and easily mounted onto the upper wall. Therefore, the mount frame 1' can be stably supported by the holding bracket 30, as shown in FIG. 6.

When it is required to dismount the blind in order to repair, store or clean the blind, the installation operation of the blind is performed in reverse order. That is, the blind can be easily detached from the wall by separating the bottom plate 35 from the bracket body 31.

As described above, the present invention provides an electric blind, which is designed to be efficiently raised and lowered by lifting cords, thereby improving convenience in use and reliability of product.

In particular, since raising and lowering motions of the blind and control of tilt angle of vanes are achieved by a single drive motor, an overall structure of the blind can be simplified, and thus production cost can be decreased.

Furthermore, since a holding bracket supporting a mount frame is comprised of a bracket body and a bottom plate, the holding bracket can be easily assembled without additional assembling tools, thereby allowing the blind to be easily installed and dismounted by anybody.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An electric blind comprising:

a mount frame fixedly mounted on a wall over a window and having a certain length;

a pair of housings attached to both ends of the mount frame;

a pair of take-up cylinders rotably coupled to the housings;

lifting cords wound on the pair of take-up cylinders and unwound therefrom to be suspended by a certain length;

a rotating pipe disposed between and joined to the pair of take-up cylinders and rotated in normal and reverse directions;

a drive motor connected to the rotating pipe;

a plurality of vanes disposed below the pair of housings to be raised and lowered by the lifting cords; and means for controlling tilt angle of the vanes by a turning force of the rotating pipe.

2. The electric blind as set forth in claim 1, wherein each of the take-up cylinders is provided at its outer surface with a threaded portion and provided at its inner surface with at least one fitting protrusion, and wherein each of the housings are provided at its inner surfaces with a threaded portion to mate with the threaded portion of the take-up cylinder, and the rotating pipe is provided at its outer surface with a fitting groove corresponding to the fitting protrusion, whereby the pair of take-up cylinders are moved toward and away from each other during rotation of the rotating pipe.

3. The electric blind as set forth in claim 1, wherein the means for controlling tilt angle of the vanes comprises:

a rotating shaft axially joined to an end of the rotating pipe;

a first rotating cam rotatably coupled to an end of the rotating shaft;

a second rotating cam rotatably supported below the first rotating cam and connected to the uppermost vane of the plurality of vanes;

a connecting link connected at both its ends to the first rotating cam and the second rotating cam; and means for limiting rotation angle of the first rotating cam.

4. The electric blind as set forth in claim 3, wherein the means for limiting the rotation angle of the first rotating cam comprises:

a pair of protrusions fixed to the first rotating cam to be positioned at diametrically opposing sides;

catch members provided at the rotating shaft, the catch members coming into contact with the protrusions of the first rotating cam to transmit turning force of the rotating shaft to the first rotating cam; and a stopper fixed to the housing to limit rotation range of the protrusions of the first rotating cam.

5. The electric blind as set forth in claim 1, wherein the means for controlling a tilt angle of the vanes comprises:

a rotating ring fixedly mounted on the rotating pipe;

a tilting string wound around an outer surface of the rotating ring and having ends connected to both sides of the uppermost vane of the plurality of vanes; and a spacer provided at an end of the tilting string facing the window to maintain a certain spacing between the uppermost vane and the rotating ring.

6. The electric blind as set forth in claim 5, wherein the spacer is comprised of a plurality of balls, through which the end of the tilting string passes.

7. The electric blind as set forth in claim 5, wherein the mount frame is provided at its center with a control screw adapted to be displaced upward and downward, and a control wire connected at its one end to the control screw, and connected at its other end to the uppermost of the plurality of vanes.

8. The electric blind as set forth in claim 1, wherein the means for controlling a tilt angle of the vanes comprises:

a rotating ring fixedly mounted on the rotating pipe; and a tilting string wound around an outer surface of the rotating ring to be suspended at both ends thereof and connected to both sides of the respective vanes.

9. The electric blind as set forth in claim 8, wherein the mount frame is provided with a guide pin so as to guide the lifting cord to the suspended tilting string and to hold the housing in place.

10. The electric blind as set forth in claim 1, further comprising a holding bracket for fixing the mount frame to the wall, which includes bracket body having an end opening downward to receive the mount frame, and a bottom plate coupled the open end of the bracket body to support the mount frame.

11. The electric blind as set forth in claim 10, wherein the bracket body is formed at its one end with a first slit and formed at its other end with a retaining protrusion, and wherein the bottom plate is formed at its one end with a second slit to engage with the first slit of the bracket body, and formed at its other end with a cut portion to engage with the retaining protrusion of the bracket body.

* * * * *